US011326505B1

(12) United States Patent
Ali Khan et al.

(10) Patent No.: US 11,326,505 B1
(45) Date of Patent: May 10, 2022

(54) SYSTEM AND METHOD USING FAN CONTROL TO ASSIST VEHICLE BRAKING

(71) Applicant: GM GLOBAL TECHNOLOGY OPERATIONS LLC, Detroit, MI (US)

(72) Inventors: Maqsood Rizwan Ali Khan, Troy, MI (US); Mark R. Claywell, Birmingham, MI (US); Paul M. Riherd, II, Royal Oak, MI (US); Bryston Hollis, Milford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/090,979

(22) Filed: Nov. 6, 2020

(51) Int. Cl.

| | |
|---|---|
| ***F02D 41/00*** | (2006.01) |
| ***F02D 19/00*** | (2006.01) |
| ***F01P 7/04*** | (2006.01) |
| ***F01P 7/08*** | (2006.01) |

(52) U.S. Cl.
CPC ..... *F01P 7/048* (2013.01); *F01P 7/082* (2013.01); *F01P 2025/46* (2013.01); *F01P 2025/60* (2013.01)

(58) Field of Classification Search
CPC ..... B60W 10/06; B60W 20/14; B60W 20/15; B60W 30/18136; B60W 30/18109; F02D 41/022; F02D 41/0005; F01P 7/048
See application file for complete search history.

(56) References Cited

U.S. PATENT DOCUMENTS

| | | | | |
|---|---|---|---|---|
| 5,359,969 | A * | 11/1994 | Dickrell | F01P 7/08 123/41.01 |
| 6,044,809 | A * | 4/2000 | Till | F01P 7/08 123/41.12 |
| 6,067,489 | A * | 5/2000 | Letang | F01P 7/04 123/299 |
| 6,376,927 | B1 * | 4/2002 | Tamai | B60K 6/383 290/40 C |
| 2009/0164084 | A1 * | 6/2009 | Hawkins | F01P 7/08 701/102 |
| 2011/0132292 | A1 * | 6/2011 | Schwartz | F01P 7/048 123/41.12 |

* cited by examiner

*Primary Examiner* — Long T Tran

(57) ABSTRACT

A system for controlling a fan of a vehicle engine. The system comprises: i) a fan configured to selectively cool the vehicle engine; and ii) an engine control module configured to: a) turn on the fan when the engine temperature exceeds a selected temperature threshold; b) determine when the vehicle engine is operating in an engine braking mode; and c) in response to the engine operating in the engine braking mode, turn on the fan when the engine temperature is below the selected temperature threshold. The engine control module turns the fan off as a means of hardware protection of the fan clutch even during engine braking modes.

11 Claims, 3 Drawing Sheets

SYSTEM AND METHOD USING FAN CONTROL TO ASSIST VEHICLE BRAKING

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to systems and methods of engine braking in a motor vehicle. Engine braking uses the retarding forces within an engine to slow down a car or truck, instead of using the foot brakes. By shifting to lower gears, engine braking controls the speed at which a vehicle travels downhill, thereby reducing the need to apply the foot brake and the risk of the brakes overheating. The braking force is produced by friction in the drive train and from the manifold vacuum caused by air-flow restriction.

In heavy vehicles, a diesel engine may provide extra braking power to reduce the load on the regular brake system and to avoid overheating. Diesel engines may use a butterfly valve that restricts exhaust flow, a process referred to as an exhaust brake. Many diesels have emission controls that create obstructions in the exhaust, which effectively creates engine braking like a gasoline engine. These obstructions may include: i) a turbocharger that creates back-pressure when stalled; ii) an exhaust gas recirculation valve that directs exhaust gas back into the engine intake; and iii) a diesel particulate filter that filters soot from the exhaust.

SUMMARY

It is an object of the present disclosure to provide a system for controlling a fan of a vehicle engine. The system comprises: i) a fan configured to selectively cool the vehicle engine; and ii) an engine control module configured to: a) turn on the fan when the engine temperature exceeds a selected temperature threshold; b) determine when the vehicle engine is operating in an engine braking mode; and c) in response to the vehicle engine operating in the engine braking mode, turn on the fan when the engine temperature is below the selected temperature threshold.

In one embodiment, the engine control module is configured to monitor the status of the fan and an engine speed.

In another embodiment, the system comprises a clutch configured to selectively turn on the fan.

In yet another embodiment, the fan is an electronically controlled mechanical fan.

In still another embodiment, the engine control module is configured to control the clutch to turn on the fan.

In a further embodiment, the engine control module is configured to determine when the engine speed is greater than a selected speed threshold value.

In a still further embodiment, the engine control module, in response to a determination that the engine speed is greater than the selected speed threshold value, is configured to turn off the fan.

In a yet further embodiment, the engine control module, in response to a determination that the engine speed does not exceed the selected speed threshold value, maintains engagement of the fan.

It is another object of the present disclosure to provide a method for controlling a fan of a vehicle engine. The method comprises: i) engaging a fan to selectively cool the vehicle engine when an engine temperature exceeds a selected temperature threshold; ii) determining when the vehicle engine is operating in an engine braking mode; and iii) in response to the vehicle engine operating in the engine braking mode, engaging the fan when the engine temperature is below the selected temperature threshold.

In one embodiment, the method further comprises monitoring a status of the fan and an engine speed.

In another embodiment, wherein engaging the fan comprises using a clutch to engage the fan.

In still another embodiment, the clutch is an electronically controlled mechanical fan.

In yet another embodiment, the method further comprises determining when the engine speed is greater than a selected speed threshold value.

In a further embodiment, the method further comprises, in response to the engine speed being greater than the selected speed threshold value, disengaging the fan.

In a yet further embodiment, the method further comprises, in response to the engine speed being less than the selected speed threshold value, maintaining engagement of the fan.

It is still another object of the present disclosure to provide a system for controlling a fan of a vehicle engine. The system comprises: i) a fan configured to selectively cool the vehicle engine; ii) an electronically controlled mechanical clutch configured to selectively turn on the fan; and iii) an engine control module configured to: a) cause the electronically controlled mechanical clutch to turn on the fan when an engine temperature exceeds a selected temperature threshold; b) determine when the vehicle engine is operating in an engine braking mode; and c) in response to the vehicle engine operating in the engine braking mode, cause the electronically controlled mechanical clutch to turn on the fan when the engine temperature is below the selected temperature threshold.

In one embodiment, the engine control module is configured to monitor a status of the fan and an engine speed.

In another embodiment, the engine control module is configured to determine when the engine speed is greater than a selected speed threshold value.

In still another embodiment, the engine control module, in response to a determination that the engine speed is greater than the selected speed threshold value, causes the electronically controlled mechanical clutch to turn off the fan.

In yet another embodiment, the engine control module, in response to a determination that the engine speed does not exceed the selected speed threshold value, maintains engagement of the fan.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The present disclosure describes an apparatus and method for significantly increasing the torque of the engine braking without putting the engine in further stress. The disclosed apparatus provides modulation of engine braking through selective engagement of the engine fan to increase the amount of engine braking. In a typical embodiment of the disclosure, the mechanical fan has an electronically controlled mechanical clutch on the vehicle engine. Normally, when the engine is cool enough, the engine fan will disengage, thereby allowing a high slip between the fan and fan shaft. As the engine spends more time in engine braking, the engine cool and the fan disengages. However, the disclosed apparatus keeps the fan engaged even though the fan is not needed for cooling purposes. The fan engagement increases the torque consumption by the engine. This allows the engine to consume more torque and keeps a consistently high engine braking torque.

The disclosed apparatus engages the mechanical fan at higher engine RPM, regardless of engine temperature, under engine braking conditions and keeps the fan engaged even after engine has cooled down. Thus, modulation of fan engagement based on the exhaust brake demand maintains braking performance. Fan engagement may be modulated to reduce the engine RPM (durability benefit) or for better noise, vibration, and harshness (NVH) performance. The transmission fluid for the fan clutch may be selected to improve engagement without compromising durability.

Figure 1:
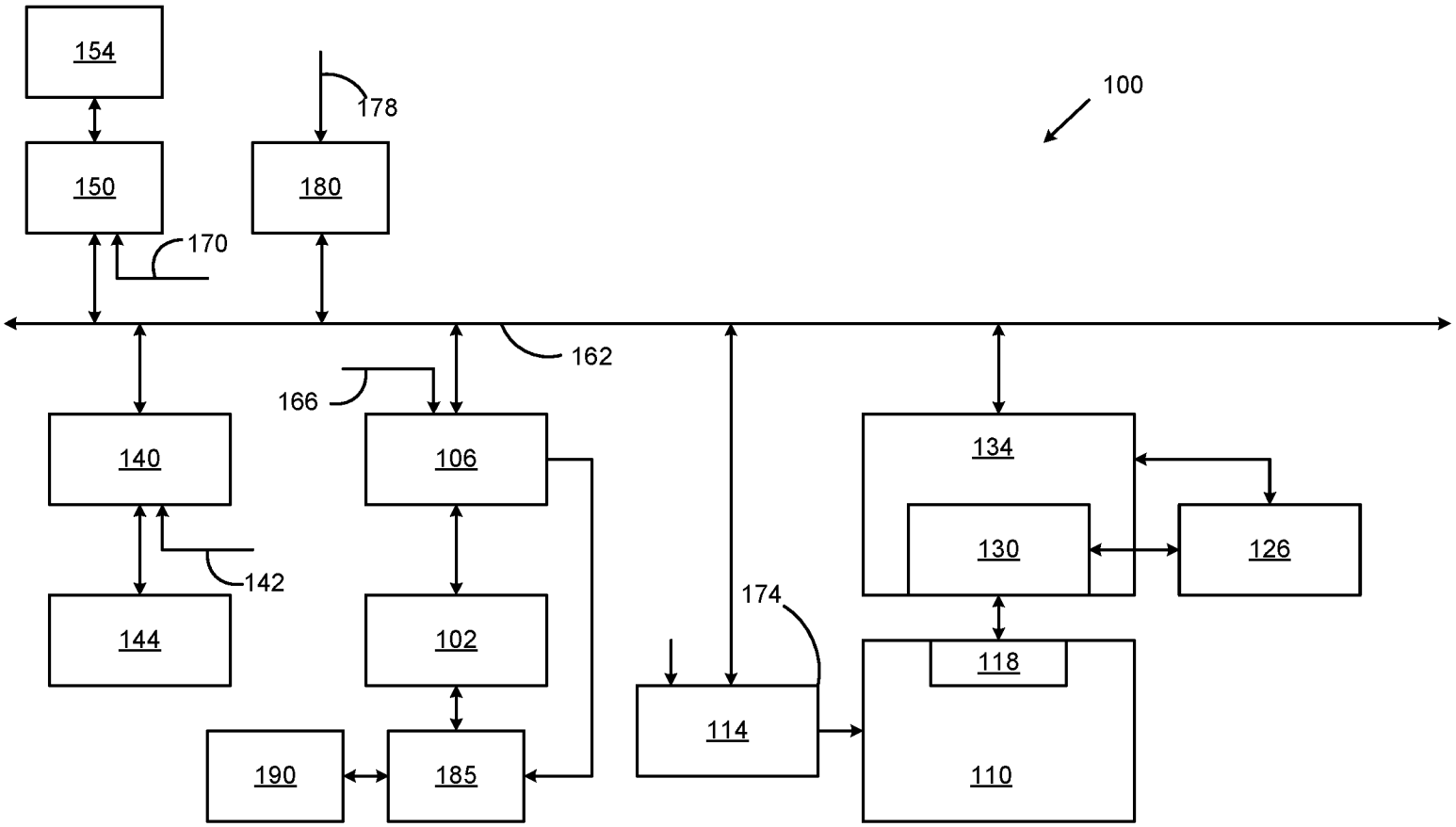
FIG. 1 is a functional block diagram of an exemplary vehicle system that includes a fan control system to assist in vehicle braking according to an embodiment of the present disclosure.

FIG. 1 is a functional block diagram of an exemplary vehicle system 100 that includes a fan control system to assist in vehicle braking according to the principles of the disclosure. While a vehicle system for a manually driven hybrid vehicle is shown and described, the present disclosure is also applicable to autonomously driven vehicles and to non-hybrid vehicles incorporating a conventional internal combustion engine. This may include both cars and trucks using diesel engines and gasoline engines. Also, while the example of a vehicle is provided, the present application may also be applicable to non-automobile implementations, such as trains, or heavy machinery used in the construction and agriculture industries.

An engine 102 combusts an air/fuel mixture to generate drive torque. An engine control module (ECM) 106 controls the engine 102 based on one or more driver or vehicle inputs. For example, the ECM 106 may control actuation of engine actuators, such as a throttle valve, one or more spark plugs, one or more fuel injectors, valve actuators, camshaft phasers, an exhaust gas recirculation (EGR) valve, one or more boost devices, and other suitable engine actuators.

The engine 102 may output torque to a transmission 110. A transmission control module (TCM) 114 controls operation of the transmission 110. For example, the TCM 114 may control gear selection within the transmission 110 and one or more torque transfer devices (e.g., a torque converter, one or more clutches, etc.).

The vehicle system 100 may include one or more electric motors. For example, an electric motor 118 may be implemented within the transmission 110 as shown in the example of FIG. 1A. An electric motor can act as either a generator or as a motor at a given time. When acting as a generator, an electric motor converts mechanical energy into electrical energy. The electrical energy may charge a battery 126 via a power control device (PCD) 130. When acting as a motor, an electric motor generates torque that supplements or replaces torque output by the engine 102. While the example of one electric motor is provided, the vehicle may include zero or more than one electric motor.

A power inverter control module (PIM) 134 may control the electric motor 118 and the PCD 130. The PCD 130 applies (e.g., direct current) power from the battery 126 to the (e.g., alternating current) electric motor 118 based on signals from the PIM 134, and the PCD 130 provides power output by the electric motor 118, for example, to the battery 126. The PIM 134 may be referred to as a power inverter module (PIM) in various implementations.

A steering control module 140 controls steering/turning of wheels of the vehicle, for example, based on driver turning of a steering wheel within the vehicle and/or steering commands from one or more vehicle control modules. A steering wheel angle sensor (SWA) monitors rotational position of the steering wheel and generates a SWA 142 signal based on the position of the steering wheel. As an example, the steering control module 140 may control vehicle steering via an EPS motor 144 based on the SWA 142 signal. However, the vehicle may include another type of steering system. An electronic brake control module (EBCM) 150 may selectively control brakes 154 of the vehicle.

Modules of the vehicle may share parameters via a controller area network (CAN) 162. The CAN 162 may also be referred to as a car area network. For example, the CAN 162 may include one or more data buses. Various parameters may be made available by a given control module to other control modules via the CAN 162.

The driver inputs may include, for example, an accelerator pedal position (APP) 166 which may be provided to the ECM 106. A brake pedal position (BPP) 170 may be provided to the EBCM 150. A position 174 of a park, reverse, neutral, drive lever (PRNDL) may be provided to the TCM 114. An ignition state 178 may be provided to a body control module (BCM) 180. For example, the ignition state 178 may be input by a driver via an ignition key, button, or switch. At a given time, the ignition state 178 may be one of off, accessory, run, or crank.

According to an exemplary embodiment of the present disclosure, the vehicle system 100 further comprises an electronically controlled mechanical (ECM) clutch 185 and a fan 190. The engine control module 106 controls the operation of the ECM clutch 185, which in turn controls the selective engagement of the clutch 190 according to the principles of the present disclosure. The engine control module 106 monitors the temperature of the engine and detects when engine braking occurs. The engine control module 106 causes the ECM clutch 185 to engage the mechanical fan 190 at higher engine RPM, regardless of engine temperature, under engine braking conditions. The engine control module 106 may keep the fan 190 engaged even after the engine 102 has cooled down in order to increase engine braking.

Figure 2:
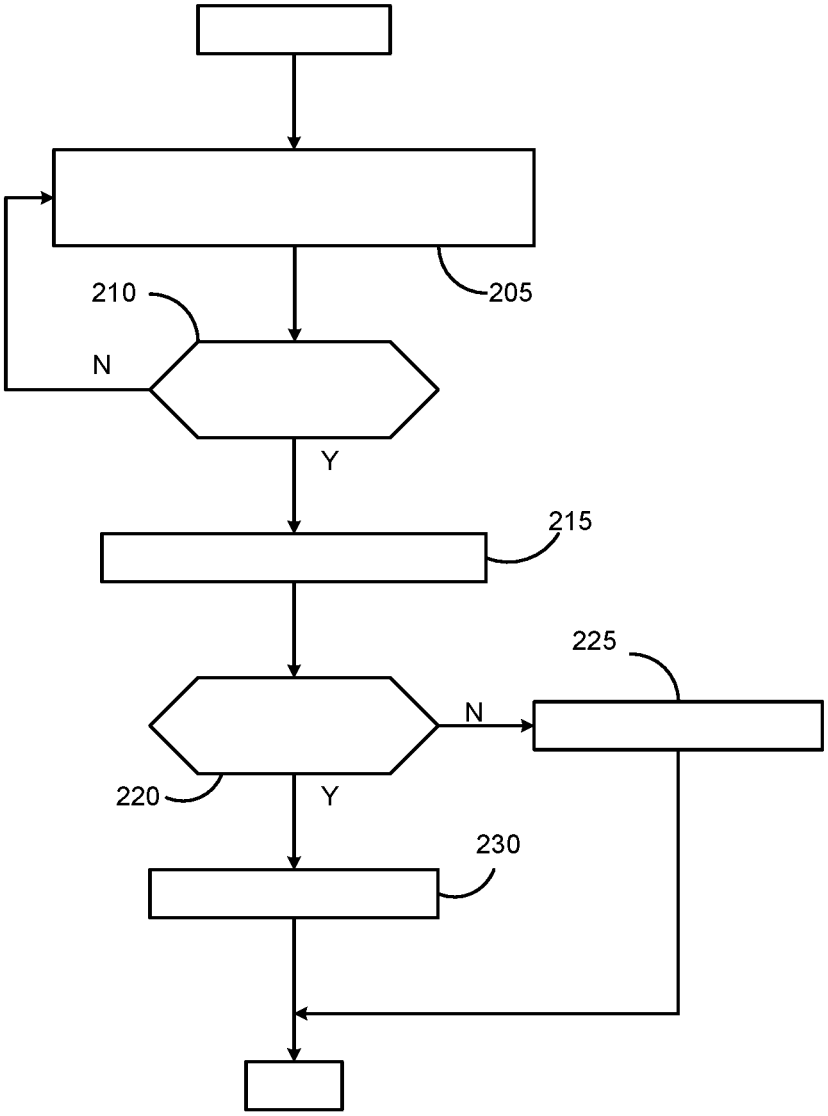
FIG. 2 is a flow diagram illustrating the operation of the fan control system according to an embodiment of the present disclosure.

FIG. 2 is a flow diagram illustrating the operation of the fan control system according to an embodiment of the present disclosure. In 205, the engine control module 106 monitors i) the engine speed (e.g., RPM) and ii) the status of the fan 190 (i.e., ON or OFF). In normal conditions, the fan 190 engages when the temperature of the engine exceeds a first selected temperature threshold. Also, in normal conditions, if the engine is not in exhaust braking mode, the fan 190 disengages when the engine temperature falls below a second selected temperature threshold. The first and second temperature thresholds may or may not be the same.

However, in 210, the engine control module 106 determines if the engine 102 is in exhaust braking mode. If NO in 210, the engine control module 106 returns to 205 and continues to monitor the engine speed and the fan status. If YES in 210, the engine control module 106 in 215 keeps the fan 190 engaged even if the engine temperature falls below the second selected temperature threshold.

Next, in 220, the engine control module 106 determines if the engine speed exceeds a selected speed threshold value. The selected speed threshold value represents an upper limit on engine speed as described below in FIG. 3. If NO in 220, the engine control module 106 keeps the fan 190 engaged. This is true even though the engine may be cool. If YES in 220, the engine control module 106 may disengage the fan 190.

Figure 3:
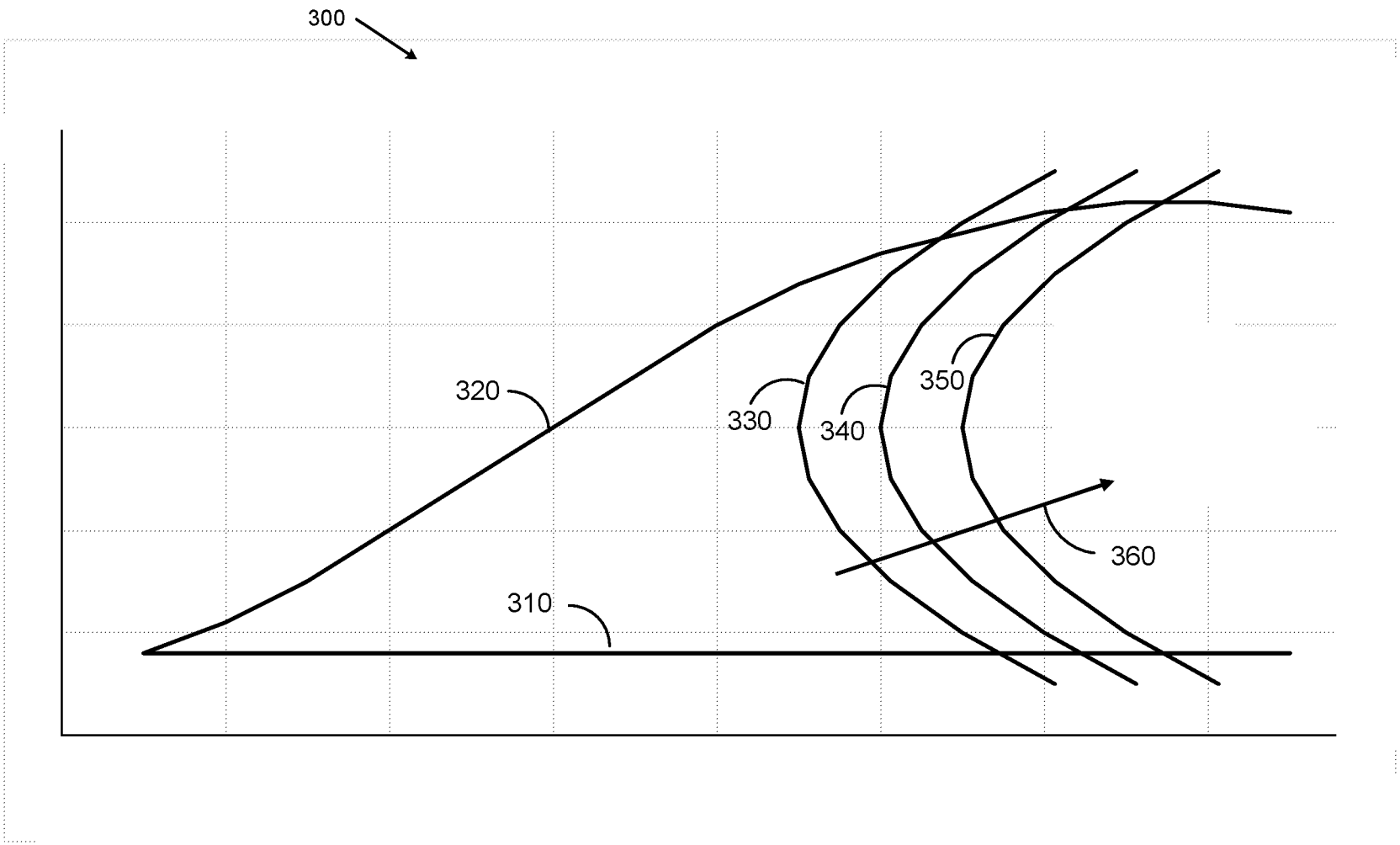
FIG. 3 illustrates exemplary slip heat curves used to control the operation of the fan control system according to an embodiment of the present disclosure.

FIG. 3 illustrates an exemplary slip heat curve used to control the operation of the fan control system according to an embodiment of the present disclosure. In FIG. 3, the horizontal axis represents the drive train input speed to the fan clutch 185. The input speed has a proportional speed to the engine speed, based on any intermediate gearing or pulleys between the engine crank shaft and fan clutch. The vertical axis represents the speed of the fan 190. Curve 310 represents the fully disengaged fan speed. Curve 320 represents the fully engaged fan speed.

The curves 330, 340 and 350 are associated with different environmental conditions that may limit the engagement of the fan 190. By way of example, each of the curves 330, 340, and 350 may be associated with selected temperature and air pressure conditions. The curves 330, 340, and 350 represent engine speed threshold values that may be used in item 220 in FIG. 2. The engine control module 106 and the ECM clutch 185 maintain the operation of the fan 190 in the region between curves 310 and 320 and to the left of the curves 330, 340 and 350. The arrow 360 indicates increased heat rejection that allows the engine speed threshold values to be moved to the right (e.g., from curve 330 towards curve 350) to allow for greater slip of the ECM clutch 185. In an exemplary embodiment, the speed thresholds represented by curves 330, 340, and 350 may be stored in a memory associated with the engine control module 106.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure. It should also be understood that steps in the embodiments can also be eliminated. For instance, all of the routing based assessments and actions can be eliminated so that only buckling and possibly occupancy are monitored and acted upon with actions.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system for controlling a fan of a vehicle engine comprising:

a fan configured to selectively cool the vehicle engine; and an engine control module configured to:

turn on the fan when an engine temperature exceeds a selected temperature threshold;

determine when the vehicle engine is operating in an engine braking mode;

in response to the vehicle engine operating in the engine braking mode, turn on the fan when the engine temperature is below the selected temperature threshold;

select a speed curve from a group of speed curves based on a temperature and an air pressure condition;

select a speed threshold value from the selected speed curve;

determine whether an engine speed is greater than the selected speed threshold value;

in response to a determination that the engine speed is greater than the selected speed threshold value, turn off the fan;

in response to a determination that the engine speed is not greater the selected speed threshold value, maintain engagement of the fan; and increase slip of a clutch of the fan as the selected speed threshold value increases.

2. The system of claim 1, wherein the engine control module is configured to monitor a status of the fan and the engine speed.

3. The system of claim 2, further comprising the clutch configured to selectively turn on the fan.

4. The system of claim 3, wherein the fan is an electronically controlled mechanical fan.

5. The system of claim 3, wherein the engine control module is configured to control the clutch to turn on the fan.

6. A method for controlling a fan of a vehicle engine comprising:

engaging a fan to selectively cool the vehicle engine when an engine temperature exceeds a selected temperature threshold;

determining when the vehicle engine is operating in an engine braking mode; and in response to the vehicle engine operating in the engine braking mode, engaging the fan when the engine temperature is below the selected temperature threshold;

selecting a speed curve from a group of speed curves based on a temperature and an air pressure condition;

selecting a speed threshold value from the selected speed curve;

determining whether an engine speed is greater than the selected speed threshold value;

in response to a determination that the engine speed is greater than the selected speed threshold value, turning off the fan;

in response to a determination that the engine speed is not greater the selected speed threshold value, maintaining engagement of the fan; and increasing slip of a clutch of the fan as the selected speed threshold value increases.

7. The method of claim 6, further comprising monitoring a status of the fan and the engine speed.

8. The method of claim 7, wherein engaging the fan comprises using the clutch to engage the fan.

9. The method of claim 8, wherein the clutch is an electronically controlled mechanical fan.

10. A system for controlling a fan of a vehicle engine comprising:

a fan configured to selectively cool the vehicle engine;

an electronically controlled mechanical clutch configured to selectively turn on the fan; and an engine control module configured to:

cause the electronically controlled mechanical clutch to turn on the fan when an engine temperature exceeds a selected temperature threshold;

determine when the vehicle engine is operating in an engine braking mode;

in response to the vehicle engine operating in the engine braking mode, cause the electronically controlled mechanical clutch to turn on the fan when the engine temperature is below the selected temperature threshold;

select a speed curve from a group of speed curves based on a temperature and an air pressure condition;

select a speed threshold value from the selected speed curve;

determine whether an engine speed is greater than the selected speed threshold value;

in response to a determination that the engine speed is greater than the selected speed threshold value, turn off the fan;

in response to a determination that the engine speed is not greater the selected speed threshold value, maintain engagement of the fan; and increase slip of the electronically controlled mechanical clutch as the selected speed threshold value increases.

11. The system of claim 10, wherein the engine control module is configured to monitor a status of the fan and an engine speed.

* * * * *